US006474776B1

(12) United States Patent
Murray

(10) Patent No.: US 6,474,776 B1
(45) Date of Patent: Nov. 5, 2002

(54) INK JET CARTRIDGE WITH TWO JET PLATES

(75) Inventor: Richard A. Murray, San Diego, CA (US)

(73) Assignee: Encad, Inc., San Diego, CA (US)

( * ) Notice: Subject to any disclaimer, the term of this patent is extended or adjusted under 35 U.S.C. 154(b) by 0 days.

(21) Appl. No.: 09/262,697

(22) Filed: Mar. 4, 1999

(51) Int. Cl.[7] ..... B41J 2/145
(52) U.S. Cl. ..... 347/40; 347/86; 347/12
(58) Field of Search ..... 347/40, 42, 41, 347/43, 12, 14, 15, 86

(56) References Cited

U.S. PATENT DOCUMENTS 5,124,720 A * 6/1992 Schantz ..... 347/40
5,384,587 A * 1/1995 Takagi et al. ..... 347/41
5,488,397 A 1/1996 Nguyen et al. ..... 347/40
5,541,624 A 7/1996 Cooke et al. ..... 347/86
5,581,283 A 12/1996 Rogers ..... 347/40
5,610,635 A 3/1997 Murray et al. ..... 347/19
5,896,147 A * 4/1999 Mori et al. ..... 347/61
5,923,349 A * 7/1999 Meyer ..... 347/43
5,988,801 A * 11/1999 Coiner ..... 347/86
6,172,700 B1 * 1/2001 Obata ..... 347/237

* cited by examiner

*Primary Examiner*—Lamson Nguyen
(74) *Attorney, Agent, or Firm*—Jeffrey A. Ellsworth; Milton S. Sales

(57) ABSTRACT

An ink jet cartridge includes two adjacent jet plates, each jet plate having an array of equally spaced nozzles. A small gap exists between the first and second jet plates which is devoid of any jet nozzles. The absence of nozzles in the gap is compensated for by the inkjet printer system such that the two jet plates function as a single nozzle array.

28 Claims, 6 Drawing Sheets

INK JET CARTRIDGE WITH TWO JET PLATES

BACKGROUND OF THE INVENTION

1. Field of the Invention

The invention relates generally to the field of printer ink cartridges and, more particularly, to a high throughput inkjet printer cartridge having two or more inkjet nozzle arrays.

2. Description of the Related Technology

Inkjet cartridges are used in inkjet printers which are a class of non-contact printers characterized by rapid heating and expulsion of ink from nozzles on one or more inkjet cartridges onto a recording medium, e.g., paper. Many inkjet cartridges are passive devices, i.e., use passive components on a jet plate assembly, such as resistors, to heat the ink in the cartridge to a point at which the ink is expelled from jet nozzles or openings in the jet plate. The resistors are formed utilizing thick or thin film technology on a substrate. Typically, one resistor per orifice or jet is required.

In multi-color ink jet printing, an image is assembled from several overlaid color planes. Each color plane comprises an array of ink droplets of a particular color deposited on a two dimensional grid. The grid size is defined by the resolution of the printer, and is typically 150, 300, or 600 dots per inch in each dimension. To produce an image, multiple ink jet print heads (typically four), one for each color, are passed over the media, and each printhead selectively ejects droplets of ink onto the appropriate grid locations to produce the color plane associated with that print head. Generally, the print heads comprise a jet plate having a vertically extending array of nozzles spaced apart according to the print resolution, i.e. 1/150th , 1/300th, or 1/600th inches apart, in the vertical direction. The printed image is produced by passing the printhead over a horizontal band of the media, depositing the appropriate drops of ink, incrementing the media vertically, passing the printhead over another horizontal band of media, and so on, until the printhead has printed the entire extent of the desired image. A given color plane is thus built up from a large number of adjacent horizontal swaths of deposited ink droplets.

In performing this operation, the printer sends control signals to the resistors on the cartridge to control the firing sequence of the jet nozzles as the cartridge move along the page. One of the first printer ink cartridges that used this design was marketed by Hewlett-Packard in approximately 1984 and was sold under the trade name Think Jet Cartridge. The Think Jet Cartridge had 12 jet nozzles and required 13 interconnect lines to the printer system to control the application of ink by the cartridge. The design and operation of the Think Jet Cartridge is described in more detail in an article entitled "History of Think Jet Printhead Development," published in the Hewlett-Packard Journal dated May, 1985.

In approximately 1987, Hewlett-Packard developed the deskjet thermal inkjet cartridge which increased the number of jets on a printer ink cartridge to fifty. Therefore, the deskjet cartridge requires fifty-six interconnect lines to the printer system to control the application of ink by the cartridge. The design and operation of the original deskjet cartridge is described in more detail in an article entitled, "Low Cost Plain Paper Printing," published in The Hewlett-Packard Journal dated August 1992.

More recently, Hewlett-Packard designed a thermal printer ink cartridge, part no. HP51640, used in a Deskjet 1200 printer also by Hewlett-Packard which incorporated a portion of the driver electronics and some control logic onto the jet plate of the printer ink cartridge. In this particular case, the jet plate is composed of the following structures: (1) a silicon substrate which houses the driver control for each chip, (2) some control logic circuitry to determine which jet is to be fired; and (3) the heat generating resistors. Since the driver control circuitry and the control logic circuitry are proximate to the heat generating resistors, the driver control logic circuitry is susceptible to the heat generated by the heat generating resistors. The jet plate is located proximate to the jet nozzles to heat the ink for expulsion. The design and operation of the Deskjet 1200 cartridge is described in more detail in two articles entitled, "The Third-Generation HP Thermal Inkjet Printhead" and "Development of the HP Deskjet 1200C Print Cartridge Platform" published in The Hewlett-Packard Journal dated February, 1994.

In the case of developing a silicon integrated circuit on a jet plate to drive and control the operation of the jets, a number of factors directly affect the size of the circuitry required. Initially, each jet nozzle requires one heating element, such as the resistor, one drive control circuit and one or more control signals to indicate when the jet nozzle is to be fired. As the number of jets increases, the size of the silicon substrate required to house the driver circuits, control circuits, and the heating elements increases proportionally. Also, the increased number of jets, for example 84 jets, requires a silicon die having an inefficient shape or having a large aspect ratio, i.e., a die having a long length and a short width, because the increased number of jets causes the die to increase in length. Both large dies and dies with a large aspect ratio are very difficult to manufacture, further decreasing processing yields and increasing production costs.

In addition to the problems of silicon yield for such large circuits, the circuitry on the jet plate must be able to withstand the heat generated by the resistors as well as problems associated with silicon coming into constant contact with moving heated ink. Therefore, the production of the silicon integrated circuit on the jet plate must include additional steps to prevent long-term degradation of the silicon due to contact with the chemicals in the ink, and due to cavitation problems caused by the moving ink, etc. These processes increase the production cost for making a jet plate. The same processes may also decrease the performance characteristics of the driver and logic circuits on the jet plate.

Subject to the above-described manufacturing limitations, manufacturers of inkjet printer cartridges, have constantly strived to increase the number of jet nozzles per cartridge. As silicon wafer processing techniques became more advanced, it became possible to manufacture larger jet plates having a greater number of jet nozzles on a single silicon wafer with increased production yields. In later printer cartridges, the nozzle arrays included up to 104 and 208 nozzles on a single printer cartridge. With 104 nozzles on a cartridge, and a print density of 300 dpi, each pass of the printer cartridge could cover a 1/3 inch swath on the recording medium. With a printer cartridge having 208 jet nozzles, the printing speed of an image having an image quality of 300 dpi could be double that of a cartridge having only 104 jet nozzles. As one may easily calculate, a cartridge having 208 nozzles is capable of printing a 300 dpi image by printing on 2/3 inch swaths per pass of the cartridge over the recording medium. Conversely, if the printing speed is to remain the same, but the image quality is to be improved, a cartridge having 208 nozzles may print an image having a dot density of 600 dpi and print swaths of ⅓ of an inch per pass of the cartridge. Thus, as the number of nozzles on a single cartridge increases, one may increase either the printing speed, the printing quality, or both.

Recently, ink jet cartridges having 300 or more jet nozzles and a corresponding jet plate assembly have been produced. Thus, a printer cartridge having 300 jet nozzles can print an image quality of 600 dpi in increments of ½ inch swaths per pass of the printer cartridge over the recording medium. For a 300 dpi jet plate, the width of each swath may be 1 inch. However, these advanced printers are relatively expensive due to their high cost of manufacturing. Thus, although, the size of the silicon substrate required to house the driver circuits, control circuits and the heating elements, otherwise referred to as the jet plate herein, increases proportionally to the number of added jet nozzles, the manufacturing costs increase at a much faster rate. The increased number of jets requires a jet plate made from a silicon die having an inefficient shape, or large aspect ratio and large dies and dies with large aspect ratios are very difficult to manufacture, decreasing processing yields and rapidly increasing production costs.

SUMMARY OF THE INVENTION

This invention provides an improved printer cartridge having a greater number of jet nozzles and an improved method of manufacturing such a printer cartridge which does not have the inherent disadvantages of low processing yields and high manufacturing costs associated with prior art printer cartridges having a relatively large number of jet nozzles. The preferred embodiment of this improved inkjet cartridge includes two individual jet nozzle arrays on a single cartridge housing.

The improved inkjet cartridge of the invention provides increased print speed and further provides a significant redundant nozzle capability to increase print image reliability and quality. This improved inkjet cartridge uses two separate, easily manufactured, low cost and highly reliable nozzle arrays mounted on a single cartridge housing to provide essentially a 100% increase in print throughput without the disadvantages of the prior art.

In one embodiment of the invention, an inkjet printer cartridge includes: a rigid body having at least one chamber for containing ink therein and a substantially planar bottom surface; a first flex circuit affixed to the rigid body, which includes: a first jet nozzle array having a first plurality of jet nozzles for expelling ink onto a recording medium, the first plurality of jet nozzles being disposed along a first region of the bottom surface of the body; at least one first contact element, coupled to the first jet nozzle array, for providing electrical connectivity between the first jet nozzle array and a printer system which transmits signals to the at least one first contact element to control the operation of the first jet nozzle array; and a second flex circuit, affixed to the rigid body, which includes: a second jet nozzle array having a second plurality of jet nozzles for expelling ink onto the recording medium, the second plurality of jet nozzles being disposed along a second region, opposite the first region, of the bottom surface of the body; and at least one second contact element, coupled to the second jet nozzle array, for providing electrical connectivity between the second jet nozzle array and the printer system which transmits signals to the at least one second contact element to control the operation of the second jet nozzle array.

In another embodiment, an inkjet printer cartridge is manufactured by a process that includes: affixing a first flex circuit to a housing of the printer cartridge such that a first portion of the first flex circuit having at least one first contact element thereon is located on a first side surface of the housing and a second portion of the first flex circuit having a first jet nozzle array thereon is located on a first region of a bottom surface of the housing, wherein the at least one first contact element is electrically coupled to the first jet nozzle array and the first jet nozzle array is aligned with respect to the dimensions of the bottom surface; and affixing a second flex circuit to the housing of the printer cartridge such that a first portion of the second flex circuit having at least one second contact element thereon is located on a second side surface, opposite the first side surface, of the housing and a second portion of the second flex circuit having a second jet nozzle array thereon is located on a second region, opposite the first region, of the bottom surface of the housing, wherein the at least one second contact element is electrically coupled to the second jet nozzle array and the second jet nozzle array is aligned with respect to the first jet nozzle array such that the first and second jet nozzle arrays function as a unitary nozzle array.

In a further embodiment, a method of manufacturing an inkjet printer cartridge, includes: affixing a first flex circuit to a housing of the printer cartridge such that a first portion of the first flex circuit having at least one first contact element thereon is located on a first side surface of the housing and a second portion of the first flex circuit having a first jet nozzle array thereon is located on a first region of a bottom surface of the housing, wherein at least one first contact element is electrically coupled to the first jet nozzle array and the first jet nozzle array is aligned with respect to the dimensions of the bottom surface; and affixing a second flex circuit to the housing of the printer cartridge such that a first portion of the second flex circuit having at least one second contact element thereon is located on a second side surface, opposite the first side surface, of the housing and a second portion of the second flex circuit having a second jet nozzle array thereon is located on a second region, opposite the first region, of the bottom surface of the housing, wherein at least one second contact element is electrically coupled to the second jet nozzle array and the second jet nozzle array is aligned with respect to the first jet nozzle array such that the first and second jet nozzle arrays function as a unitary nozzle array.

DETAILED DESCRIPTION OF THE INVENTION

Figure 1:
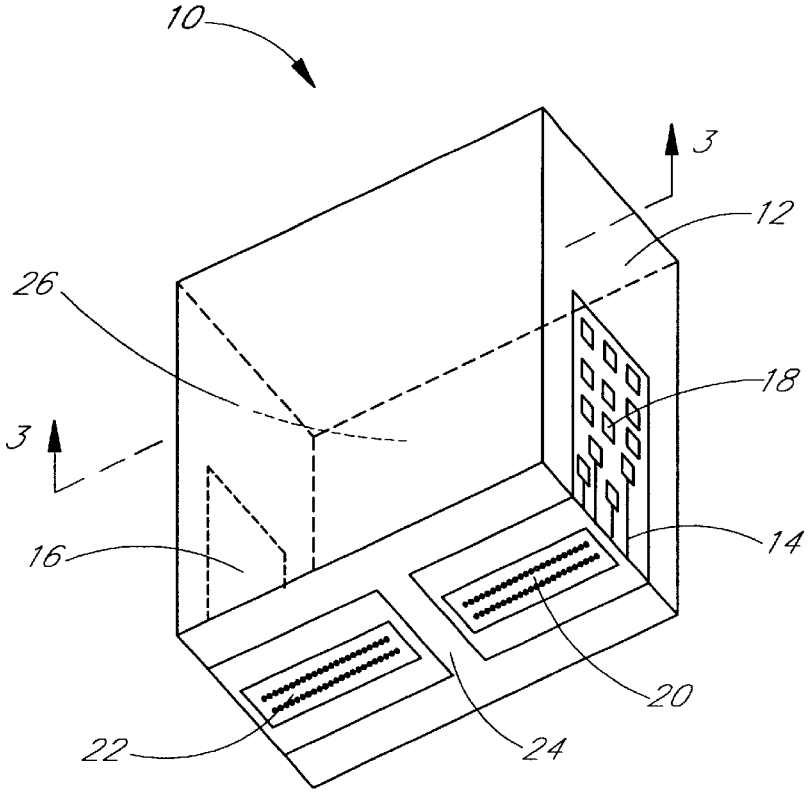
FIG. 1 is a perspective, elevated view of the improved printer cartridge having two individual flex circuits and jet nozzle arrays thereon, in accordance with one embodiment of the invention.

Referring to FIG. 1, the preferred embodiment of an inkjet cartridge 10 has a body or housing 12. Housing 12 advantageously is of an approximately rectangular shape having first and second flex circuits, 14 and 16, respectively, on oppositely disposed sides of the housing 12. Each of the first and second flex circuits 14 and 16, respectively, include a plurality of electrical conductors and contact elements 18 that provide communication with one or more devices, such as a printer system (not shown), remote from the printer cartridge 10. Preferably, each of the plurality of electrical contacts/conductors 18 on each respective flex circuit 14 and 16 mate with a corresponding external electrical contact (not shown) on a moveable print carriage (not shown) to receive/transmit information to/from the printer system. Coupling between the flex circuits 14, 16 and the print carriage may be performed in a wide variety of manners known and devisable by those of skill in the art. One such embodiment is described with reference to FIG. 5 below.

The first flex circuit 14 further couples to a first jet plate 20 having an ink jet nozzle array for ejecting ink received from an internal chamber 26 (best shown in FIG. 3), onto a recording medium such as paper. The jet plate 20 is disposed along an ink ejecting surface of the housing 10. The second flex circuit 16 couples to a second jet plate 22 disposed along the ink ejecting surface of the housing 12 on an opposite side of the housing 12 with respect to the first jet plate 20. The second jet plate 22 includes a second nozzle array in fluid communication with either the same or a separate ink chamber from the first nozzle array. As shown in FIG. 1, both the first and second flex circuits 14 and 16 bend around the corners formed at the intersection of respective side surfaces of the housing 12 and the ink ejecting surface of the housing 12.

During the manufacture and assembly of the inkjet printer cartridge 10, the first flex circuit 14 is affixed and positioned on the housing 12 of the cartridge 10 such that a portion of the first flex circuit 14 having the electrical contact elements 18 thereon is affixed, bonded or glued to a first side surface of the housing 12 and a portion of the first flex circuit 14 is affixed or bonded to a first end of a bottom surface of the housing 12. The portion of the first flex circuit 14 on the bottom of the housing 12 is coupled to the first jet plate 20 which is aligned in a desired orientation and direction with respect to the dimensions of the bottom surface of the housing 12. The first flex circuit 14 may be affixed, bonded, glued, etc. to the housing 12 of the cartridge 10 using any one several techniques which are well-known in the art.

The second flex circuit 16 is affixed to the housing 12 in a similar fashion as the first flex circuit 14, except on an opposite side of the housing 12. A portion of the second flex circuit 16 having the electrical contact elements (not shown) is affixed or bonded to a second side surface, opposite the first side surface, of the housing 12 while another portion of the flex circuit 16 is affixed to a second end of the bottom surface of the housing 12, opposite the first nozzle array 20. The second flex circuit 16 is coupled to the second jet plate 22, which is affixed to the housing 12 such that the pattern of jet nozzles of the second nozzle array 22 is substantially parallel and in widthwise alignment with the pattern of jet nozzles on the first nozzle array 20.

Figure 2:
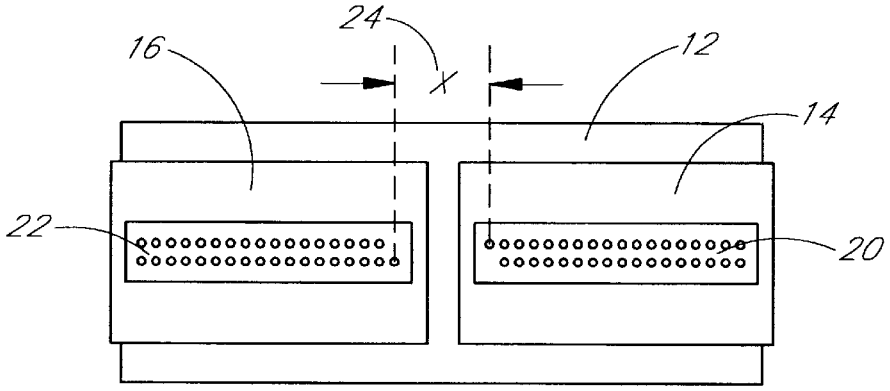
FIG. 2 illustrates a bottom view of the printer cartridge of FIG. 1.

FIG. 2 is a bottom view illustrating the first and second nozzle arrays 20 and 22, respectively, disposed along a bottom surface of the housing 12 of the printer cartridge 10 of FIG. 1. In one embodiment of the invention, there is a gap 24 having a length indicated by X between an endmost nozzle 21 on the first jet plate 22 and an endmost nozzle 23 on the second jet plate 20. Within this gap 24, there is a portion of the bottom surface of the printer cartridge housing 12 between the first and second nozzle arrays 20 and 22, respectively, which is devoid of jet nozzles. Although it is desirable to minimize the length of this gap, it will in general not be eliminated entirely. As will be explained below, however, it is advantageous to carefully control the gap 24 length such that it spans an integral number of nozzle spacings as defined by the resolution of each jet plate 20, 22. For example, the gap 24 may be 50 mil, which in a 300 dpi printer, corresponds to the vertical extent of 15 nozzle spacings. In this example, fourteen 300 dpi resolution nozzles would fit inside such a 50 mil gap 24.

As is explained below with reference to FIGS. 7 and 8, in many advantageous embodiments the individual jet plates 20 and 22 may be integrated so as to function in combination to provide a high print throughput while eliminating the need to provide the large silicon die that would be needed if the same number of nozzles were formed in a single die. In these embodiments, the printer is configured to print with the two separate jet plates 20, 22 as if they were a single, continuous nozzle array extending from one end of the ink ejecting surface of the housing 12 to the other. In these embodiments, it will be appreciated that the relative jet plate placement should be carefully controlled. In preferable embodiments, the gap 24 length and widthwise alignment of the nozzle arrays is controlled to within approximately 0.5 mil, and more preferably to within approximately 0.1 mil.

Figure 3:
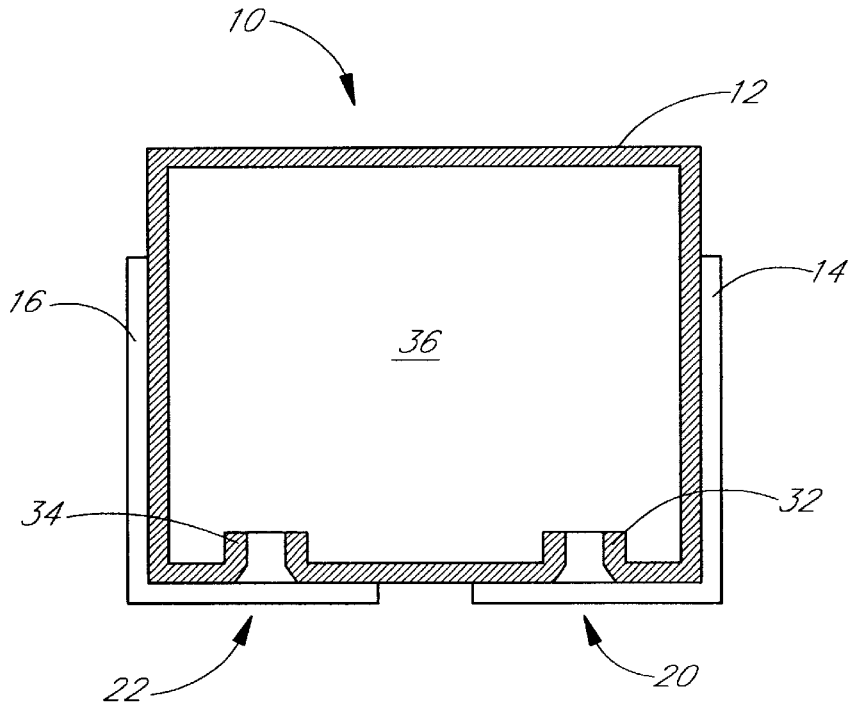
FIG. 3 is a cross-sectional view of the printer cartridge of FIGS. 1 and 2, showing a single internal ink chamber which supplies ink to both individual jet nozzle arrays on the printer cartridge.

FIG. 3 illustrates a cross-sectional view of the inkj et cartridge 10 of FIGS. 1 which shows an internal chamber 26 within the housing 12 that functions as an ink reservoir. The cartridge 10 further includes manifold assemblies 32 and 34 which supply ink from the ink reservoir 26 to respective nozzle arrays 20 and 22 of the first and second flex circuits 14 and 16, respectively. The ink reservoir 26 may take on any number of shapes to accommodate a preferred volume of ink and to conform to the envelope of the cartridge body 12. The capacity of the ink reservoir 26 may be any desired volume such as anywhere from 5 to 150 ml, for example. In one embodiment, the ink reservoir 26 receives ink from an external source which supplies ink into the reservoir 26 so as to maintain the ink level in the reservoir 26 at desired levels during printing of an image by the inkjet cartridge 10. One suitable ink supply system is described in U.S. Pat. No. 5,686,947 to Murray et al., the disclosure of which is hereby incorporated by reference in its entirety.

Each of the manifold assemblies 32 and 34 are designed to route the ink from the reservoir 26 at a desired flow rate and to deliver a desired volume of ink to each of their respective nozzle arrays 20 and 22. The design of such manifolds 32 and 34 are well-known to those of skill in the art.

Figure 4:
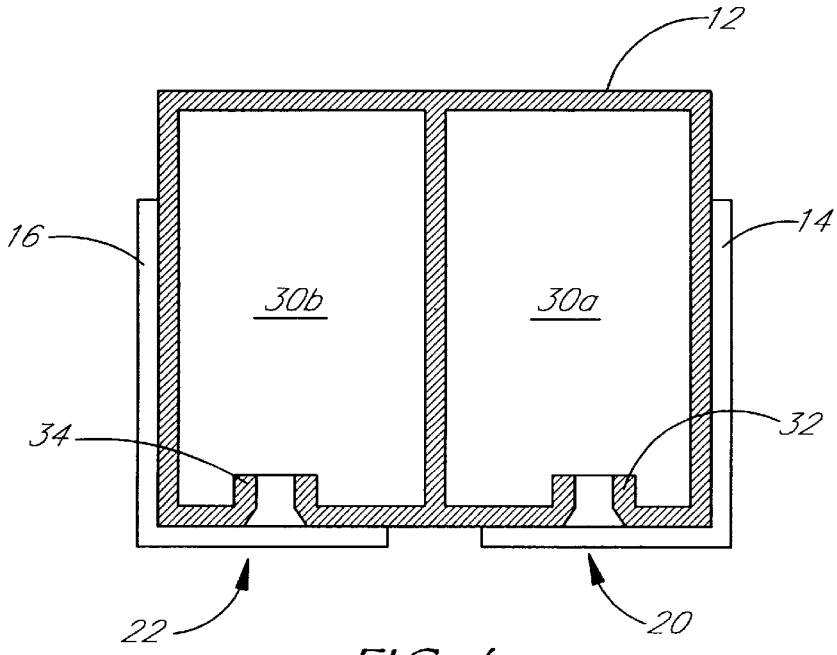
FIG. 4 is a cross-sectional view of the printer cartridge of FIGS. 1 and 2, which illustrates a separate, individual ink chamber for supplying ink to each respective jet nozzle array on the printer cartridge.

FIG. 4 illustrates a cross-sectional view of another embodiment of the printer cartridge 10 in accordance with the invention. In this embodiment, the printer cartridge 10 includes two separate and individual ink reservoirs 30A and 30B which supply ink to respective nozzle arrays 20 and 22 through respective manifold assemblies 32 and 34. By providing separate and independent ink reservoirs 30A and 30B for each nozzle array 20 and 22, each nozzle array 20 and 22 may be allocated to eject ink which is a different color or optical density from the other, for example.

Figure 5:
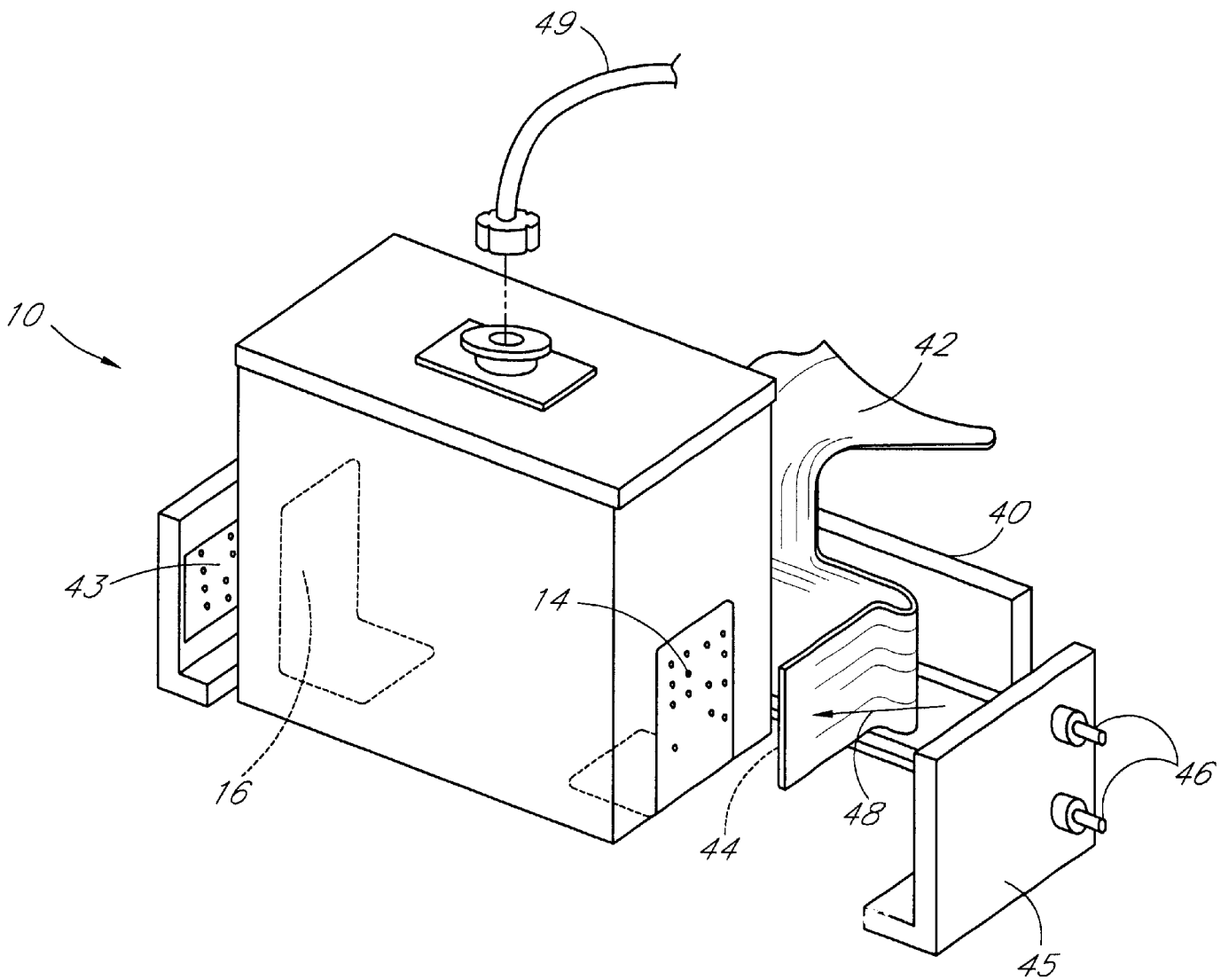
FIG. 5 is a perspective view of one embodiment of a cartridge/printer interface arrangement suitable for use with the cartridge of FIGS. 1 and 2.

One cartridge/printer interface suitable for use with the cartridges illustrated in FIGS. 1–4 is set forth in FIG. 5. It will be appreciated that electrical connections must be made with both sides of the cartridge. In this embodiment, a sliding engagement is used to accomplish this. Referring now to FIG. 5, the carriage support housing 40 forms a mounting location for a carriage flex circuit 42. The carriage flex circuit 42 includes two areas containing electrical contacts 43, 44 which are positioned on either side of the cartridge 10. These two electrical contact areas mate with the associated electrical contact areas on the cartridge flex circuits 14, 16.

To hold the contacts on the carriage flex circuit 42 against the contacts on the cartridge flex circuits 14, 16, the carriage may be provided with slide rods 46, on which a slidable cartridge engagement member 45 is mounted. The engagement member may be slid along the rods 46 in the direction of arrow 48, and be fixed in place when the electrical contacts on the carriage flex circuit 42 and the cartridge flex circuits 14, 16, are engaged. The ink chamber may receive ink from an external ink supply via tubing 48 as described above.

As mentioned above, many different mechanisms for electrically and mechanically coupling the cartridge 10 to an ink jet printer may be easily devised by those of skill in the art. For example, in addition to the sliding arrangement described above, a hinged clamp arrangement could also be utilized.

Figure 6:
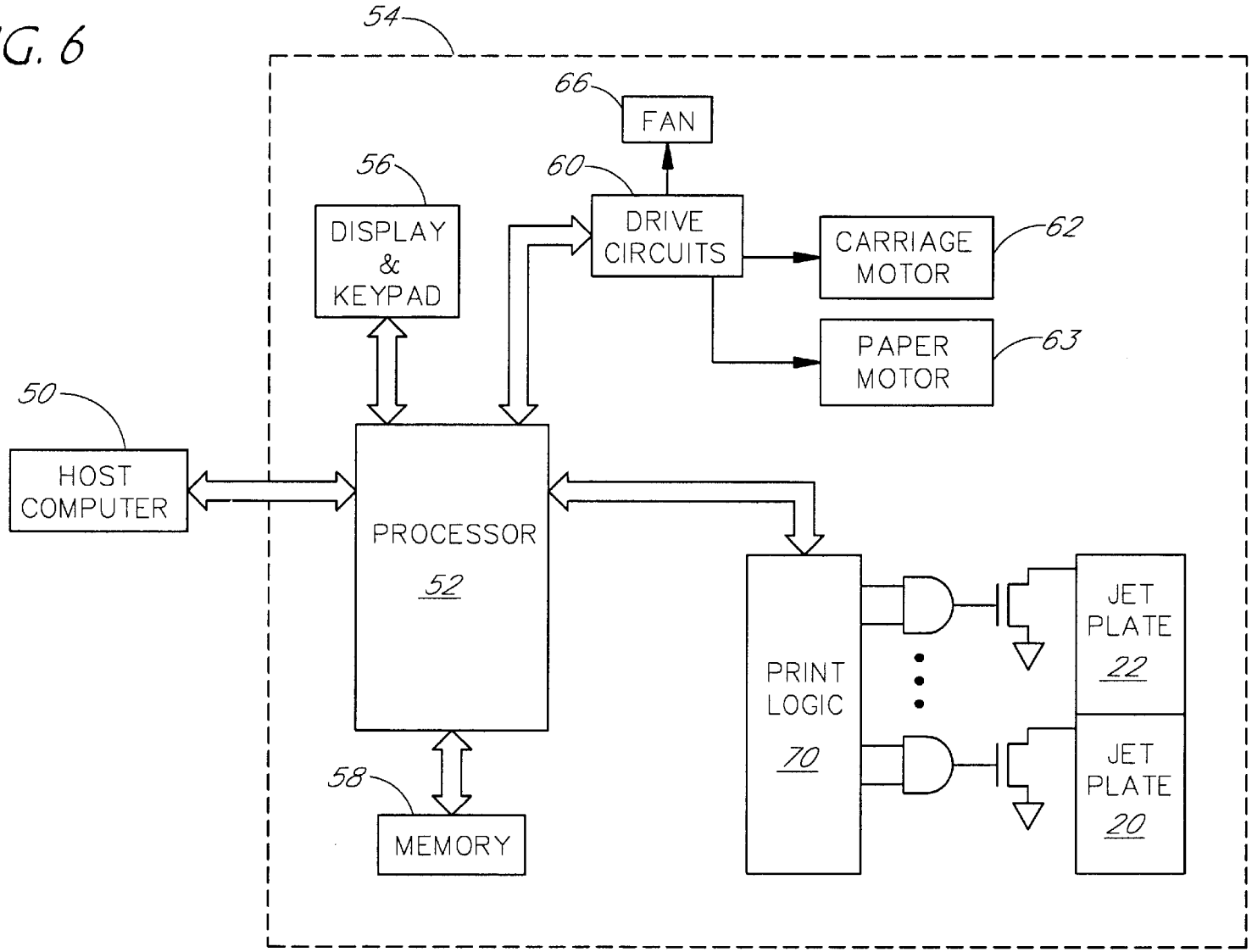
FIG. 6 is a block diagram of the components of an inkjet printer system.

Referring now to FIG. 6, various components of a typical inkjet printer 54, having a host computer 50 coupled thereto, is illustrated. These various components include control electronics of the inkjet printer 54 which are used to control ink droplet ejection from the two discrete inkjet nozzle arrays 20 and 22 located on the inkjet cartridge 44. A host computer 50 communicates with a processor 52 integral with the inkjet printer 54. The host computer 50 runs driver software which issues print commands and sends data to the inkjet printer. As in conventional inkjet printers, the processor 52 communicates with a display and keypad 56, memory 58, and drive circuits 60 which control the print carriage motor 62 and paper motor 63 as well as powering a fan 66. In addition, the processor 52 routes signals to print logic 70, which actuates the inkjet nozzles of the inkjet printhead array 20 and 22. As used herein, the terms "printhead", "cartridge" and "printhead cartridge" are use synonymously and interchangeably.

The processor 52, in accordance with internal firmware stored in a portion of the memory 58, selectively ejects ink droplets from the nozzles of the inkjet print head of each cartridge. The programming of the processor thus determines which nozzle of the print head is assigned to be used to eject an ink droplet onto any given grid location of the printed image when the relevant swath being printed calls for a droplet at that given grid location. In multi-pass printing, the set of nozzle to grid location assignments is commonly referred to as a print mask, and the print mask definition is stored in memory 58 in the inkjet printer.

In one advantageous embodiment of the invention, multi-pass printing techniques are used to compensate for the existence of the gap 24 between the nozzle arrays. FIGS. 7 and 8 illustrate, respectively, a normal four pass printing mode and a four pass printing mode which is designed to compensate for the gap 24.

As is known to those of skill in the art, the ink ejection orifices 74 of many commonly used jet plates are arranged approximately in two horizontally separated, closely spaced vertical columns. Within each column, the position of the ink ejection orifices may also be made to vary slightly in the horizontal direction for various reasons which are not pertinent to the present invention. Vertically, however, the orifices 74 are arranged such that the uppermost orifice ("orifice 1") is in one column, and "orifice 2" is 1/300 of an inch lower (in a 300 dpi printer cartridge) than orifice 1 and is in the other column. Orifice 3 is then directly below orifice 1 in the first column, but is vertically positioned 1/300th of an inch below orifice 2, i.e. 1/150th of an inch below orifice 1. The ink ejection orifices continue in this interleaved fashion down to the last orifice, which is in the column which has orifice 2 at the top on jet plates with an even number of nozzles. For clarity, FIGS. 7 and 8 of the present application do not show the horizontal displacements of the nozzles, but illustrate the effect of them as a single vertical arrangement of nozzles because the horizontal spacing aspects of the configuration described above are not directly pertinent to the present invention.

Figure 7:
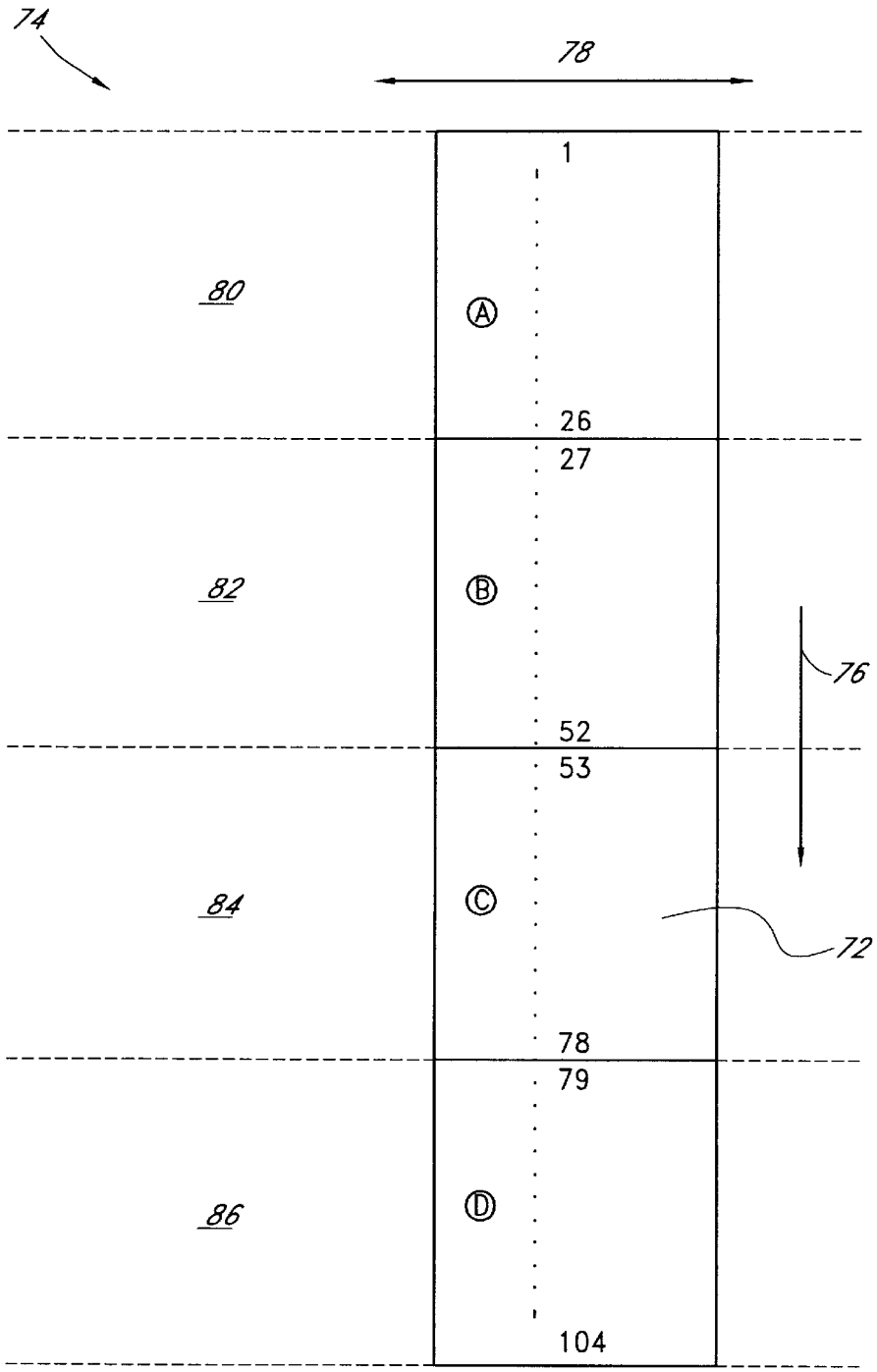
FIG. 7 Prior Art
FIG. 7 is a schematic illustration of a 104 nozzle jet plate.

Accordingly, FIG. 7 is a simplified view of a conventional single die jet plate 72 having 104 nozzles as viewed from above and through an ink jet cartridge. The media 74 being printed moves beneath the jet plate 72 in the direction of arrow 76. During printing, the jet plate moves horizontally over the media 74 in the direction of arrow 78, laying down a swath of ink dots. After a swath is printed, the media 74 is incremented in the direction of arrow 76, and the next swath is printed.

Referring again to FIG. 7, four pass printing may be implemented by functionally separating the 104 ink jet orifices into four groups of 26 orifices, designated A (jets 1–26), B (jets 27–52), C (jets 53–78), and D (jets 79–104) in FIG. 6. After each pass of the jet plate 72 over the media 74, the media 74 is incremented in the direction of the arrow 76 by a distance of (26)×(0.0033) inches, which equals the vertical extent of 26 jets in a 300 dpi printer. Thus, the image can be thought of as being constructed of many adjacent 26 line high swaths, with each one of these swaths being first partially laid down using region A of the jet plate 72 when the swath is at vertical position 80 of FIG. 6, then having a second portion of the swath laid down with region B when the swath is at vertical position 82 of FIG. 6, a third portion with region C when the swath is at vertical position 84 of FIG. 6, and finally ink deposition for this 26 line swath is completed with region D of the jet plate when the swath is at vertical position 86 of FIG. 6.

Given the 26 jet incrementing of the media 74 after each pass, the first line of a 26 line swath is deposited partially by orifice 1, partially by orifice 27, partially by orifice 53, and partially by orifice 79. Accordingly, certain conventional four pass ink jet printing methods deposit 25% of the ink in the first line of each of these swaths with jet orifice 1, 25% of the ink with jet orifice 27 in the second pass, 25% of the ink with jet orifice 53 in the third pass, and the last 25% of the ink with jet orifice 79 on the fourth pass of the jet plate. In a similar fashion, the ink in the second line of each of these swaths is deposited by sequential passes of first jet orifice 2, then 28, then 54, and then 80, and so on, with the ink in the last line of the swath being deposited by sequential passes of jet orifices 26, 52, 78, and 104.

Figure 8:
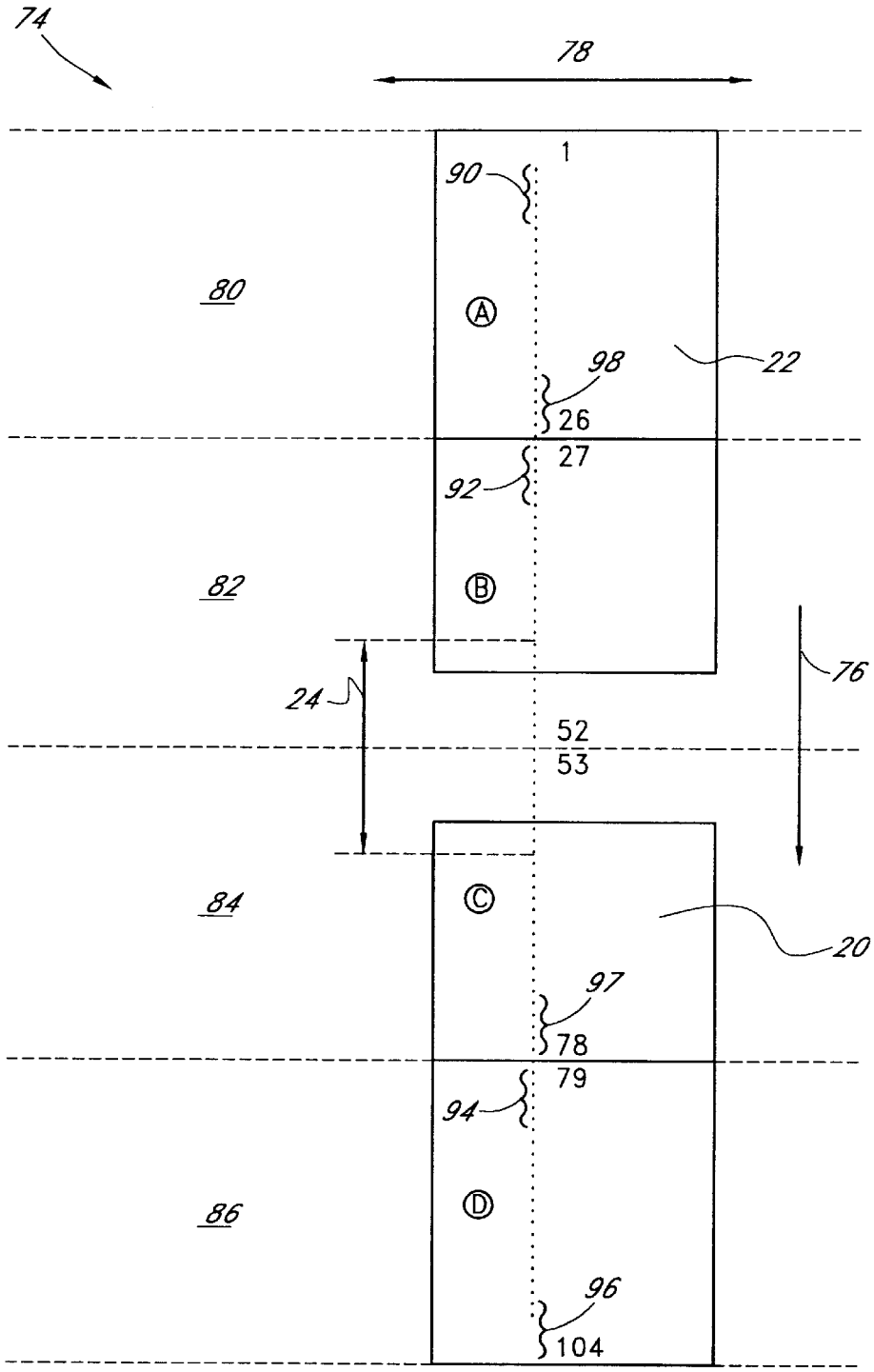
FIG. 8 is a schematic illustration of two adjacent 45 nozzle jet plates positioned and configured to operate as a single 104 nozzle jet plate.

Referring now to FIG. 8, a nozzle array made from the two jet plates 20, 22 of FIGS. 1 and 2 is illustrated. In this embodiment, the two jet plates 20, 22 each comprise 45 nozzles at 300 dpi resolution, and a 0.050 inch gap 24 separates the endmost nozzle of the first jet plate 22 from the endmost nozzle of the second jet plate 20. This gap 24 is equal to 15 nozzle separations, such that 14 nozzles could fit in the gap at the 300 dpi resolution of the jet plates 20, 22. In a four pass printing mode, these two combined nozzle plates may be segmented into the same four segments as are illustrated in FIG. 6, as if there were an additional 14 nozzles in the gap 24 to complete a single 104 nozzle array. These additional 14 nozzles are pictured as open circles in FIG. 8 between the nozzle arrays on the jet plates 20, 22.

With this jet plate configuration, the first raster line cannot be printed 25% each with nozzles 1, 27, 53, and 79 as described above with reference to FIG. 7 because nozzle 53 does not exist. To compensate for the lack of a nozzle number 53, the print mask is altered for nozzles 1, 27, and 79 such that each of these nozzles prints 33.3% of the raster line rather than 25%. This increased duty cycle is also applied to other nozzles to compensate for the remaining non-existent jets 46–52 and 54–59. Thus, in a compensated four pass printing mode, jets 1–7 (designated 90), jets 27–33 (designated 92) and jets 79–85 (designated 94) deposit ⅓ of the droplets for their raster lines to compensate for missing jets 46–52. Similarly, jets 20–26 (designated 98), jets 72–78 (designated 97) and jets 98–104 (designated 96) deposit ⅓ of the droplets for their raster lines to compensate for missing jets 53–59.

It will be appreciated by those in the art that this scheme of increasing the duty cycle of some nozzles in a multi-pass print process is easily extendable to more or fewer than four passes, as well as to larger nozzle arrays and larger or smaller gaps. In fact, it will be appreciated that gaps of arbitrary size and location may be compensated for by increasing the duty cycle of jets which print raster lines that pass under a portion of any size gap anywhere in a nozzle array. Even multiple gaps may be compensated for by treating multiple aligned nozzle arrays as a single array, and then compensating for nonexistent nozzles by increasing the duty cycle of appropriate existing nozzles. This multi-pass compensation scheme is also described in detail in co-pending, commonly-owned U.S. patent application Ser. No. 09/127,397 entitled "Open Jet Compensation During Multi-Pass Printing,", filed Jul. 31, 1998, the entire disclosure of which is incorporated herein by reference in its entirety.

As described above, the improved inkjet cartridge 10 of the invention provides increased printing speed and quality by providing two separate and individual flex circuits 14 and 16 each having its own nozzle array 20 and 22, respectively. By having two separate and individual flex circuits 14 and 16 with their own individual nozzle arrays 20 and 22, the invention provides an increased number of jet nozzles without the inherent disadvantages of manufacturing a single large nozzle array having a large number of jet nozzles thereon, as described above with respect to the prior art. For example, instead of manufacturing a single nozzle array on a single large silicon die having 300 jet nozzles, and consequently a large aspect ratio, the present invention allows one to manufacture two separate nozzle arrays each having 150 nozzles on two separate and smaller silicon dies having smaller aspect ratios. As described above, the cost of manufacturing two separate nozzle arrays each having 150 nozzles is considerably less than attempting to manufacture a single nozzle array with 300 or more jet nozzles on a single silicon substrate and also provides a greater yield. By combining these two independent nozzle arrays onto a single inkjet printer cartridge housing 12, and then compensating for the gaps 24 between the two independent nozzle arrays by using multi-pass compensation techniques, for example, the invention provides an inkjet printer cartridge 10 with double the number of inkjet nozzles, but without the inherent disadvantages of increased manufacturing costs and decreased processing yields and reliability, associated with prior art printer cartridges and manufacturing techniques.

In this manner, two inkjet nozzle arrays each having m nozzles, wherein m is an integer, function as though the jet plate has 2 m nozzles without, however, the substantially increased expense of a single silicon die providing the increased number of jet nozzles.

The invention may be embodied in other specific forms without departing from its spirit or essential characteristics. The described embodiments are to be considered in all respect only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. An inkjet printer system utilizing one or more cartridges having 2 m jet nozzles, wherein m is an integer, but whose cost of manufacture substantially is less the cost of manufacturing a conventional inkjet cartridge having the same number of jet nozzles, said printer comprising:

a processor which receives print data;

a memory, coupled to the processor, which stores at least one print mask;

at least one ink jet cartridge having a first jet plate comprising m equally spaced jet nozzles mounted to a face of said ink jet cartridge, a second jet plate comprising m equally spaced jet nozzles mounted to said face of said cartridge adjacent to said first jet plate, wherein said first jet plate and said second jet plate are physically separated with a small gap therebetween devoid of any jet nozzles; and a print logic circuit, coupled to said processor, which receives signals from the processor to control the operation of said first and second jet plates, wherein each ink jet nozzle is assigned to print respective dots on a respective raster line of a recording medium in accordance with said at least one print mask stored within said memory, and wherein said print mask compensates for the lack of ink jet nozzles in said gap.

2. The inkjet printer system of claim 1, wherein the nozzles of said second jet nozzle array are oriented and aligned with respect to the nozzles of said first jet nozzle array, and wherein the first and second jet nozzle arrays cooperate to function as a single jet nozzle array during multi-pass printing operations.

3. The inkjet printer system of claim 2, wherein the gap is compensated for by one or more jet nozzles of the first or second nozzle array during multi-pass printing operations.

4. The inkjet printer system of claim 3, wherein the print mask compensates for the gap by having each jet nozzle of a first group of jet nozzles on said first and second jet plates deposit more ink droplets on an associated raster line than the number of ink droplets deposited by each jet nozzle of a second group of jet nozzles on another raster line during multi-pass printing operations.

5. The inkjet printer system of claim 4, wherein each nozzle in the first group of jet nozzles deposits about ⅓ of the droplets on a raster line and wherein each nozzle in the second group of jet nozzles deposits about ¼ of the droplets on another raster line during a four pass printing mode.

6. The inkjet printer system of claim 1, wherein the gap is configured such that the distance between a first endmost ink jet nozzle on the first jet plate and a second endmost ink jet nozzle on the second jet plate is equal to z times n, wherein z is an integer greater than 1, and wherein n is the interval between adjacent jet nozzles on the first and second jet plates.

7. An ink jet cartridge for use in an ink jet printer comprising:

a first jet plate having an array of m equally spaced jet nozzles, said jet plate extending along less than approximately one-half of one face of said cartridge;

a second jet plate having an array of m equally spaced ink jet nozzles adjacent to said first jet plate, wherein said first jet plate and said second jet plate are separated so as to form a gap devoid of jet nozzles therebetween, and wherein said first and second jet plates are physically aligned so that said first and said second jet plates function as a unitary nozzle array having approximately 2 m ink jet nozzles, the cost of manufacture of said cartridge being substantially less than the cost of manufacturing an ink jet cartridge having a jet plate formed from a single silicon die and providing 2 m jet nozzles.

8. The ink jet cartridge of claim 7, wherein the interval between adjacent jet nozzles on the first and second jet plate is a length n, and wherein the gap is configured to be positioned between a first endmost ink jet nozzle on the first jet plate, said first ink jet nozzle positioned at an end of the array on the first jet plate adjacent to the second jet plate, and a second endmost ink jet nozzle on the second jet plate, said second endmost ink jet nozzle positioned at the end of the array on the second jet plate adjacent to the first jet plate, wherein the length of the gap is equal to z times n, wherein z is an integer greater than 1.

9. The ink jet printer cartridge of claim 8, wherein the gap has a length which is greater than or equal to fifteen times the length n.

10. An inkjet printer cartridge, comprising:

a body comprising a first surface and a chamber for containing ink therein;

a first jet nozzle array in a first substrate having a first plurality of equally spaced jet nozzles for expelling ink onto a recording medium, the first plurality of jet nozzles being disposed along a first region of the first surface of the body;

at least one first contact element, coupled to the first jet nozzle array, for providing electrical connectivity between the first jet nozzle array and a printer system which transmits signals to the at least one first contact element to control the operation of the first jet nozzle array;

a second jet nozzle array in a second substrate separate from said first substrate having a second plurality of equally spaced jet nozzles for expelling ink onto the recording medium, the second plurality of jet nozzles being disposed along a second region of the first surface of the body;

at least one second contact element, coupled to the second jet nozzle array, for providing electrical connectivity between the second jet nozzle array and the printer system which transmits signals to the at least one second contact element to control the operation of the second jet nozzle array; and a gap located on said first surface of said housing, between the first and second substrates, which is devoid of jet nozzles.

11. The inkjet printer cartridge of claim 10, wherein the nozzles of said second jet nozzle array are oriented and aligned with respect to the nozzles of said first jet nozzle array, and wherein the first and second jet nozzle arrays cooperate to function as a single jet nozzle array during multi-pass printing operations.

12. The inkjet printer cartridge of claim 10, wherein the gap is compensated for by one or more jet nozzles of the first or second nozzle array during multi-pass printing operations.

13. The inkjet printer cartridge of claim 10, wherein said chamber is coupled to an external ink source which supplies ink into the chamber such that a desired level of ink is maintained within the chamber.

14. A method of manufacturing an ink jet printer cartridge, comprising:

affixing a first flex circuit to a housing of the printer cartridge such that a first portion of the first flex circuit having at least one first contact element thereon is located on a first side surface of the housing and a second portion of the first flex circuit couples to a first jet nozzle array of equally spaced jet nozzles located on a first region of a bottom surface of the housing, wherein the at least one first contact element is electrically coupled to the first jet nozzle array and the first jet nozzle array is aligned with respect to the bottom surface; and affixing a second flex circuit to the housing of the printer cartridge such that a first portion of the second flex circuit having at least one second contact element thereon is located on a second side surface, opposite the first side surface, of the housing and a second portion of the second flex circuit couples to a second jet nozzle array of equally spaced jet nozzles located on a second region of the bottom surface of the housing, wherein the at least one second contact element is electrically coupled to the second jet nozzle array and the second jet nozzle array is aligned with respect to the first jet nozzle array such that the first and second jet nozzle arrays function as a unitary nozzle array.

15. The method of claim 14, further comprising providing a gap between the first and second jet nozzle arrays which is devoid of jet nozzles.

16. The method of claim 14 additionally comprising coupling said first jet nozzle array and said second jet nozzle array to a common ink chamber within said housing.

17. The method of claim 14, further comprising:

coupling said first jet nozzle array to a first ink chamber within said housing for providing ink to said first jet nozzle array; and coupling said second jet nozzle array to a second ink chamber within said housing for providing ink to said second jet nozzle array.

18. An ink jet cartridge for an ink jet printer comprising:

a housing comprising a ink ejecting surface, wherein said housing additionally comprises a first and second surface adjoining said ink ejecting surface, wherein said first surface and said ink ejecting surface form a first corner of said housing, and wherein said second surface and said ink ejecting surface form a second corner of said housing;

a first flex circuit extending from said first surface, around said first corner, and onto said ink ejecting surface;

a second flex circuit extending from said second surface, around said second corner, and onto said ink ejecting surface;

a first jet plate comprising an array of equally spaced jet nozzles, the first jet plate affixed to said ink ejecting surface and coupled to said first flex circuit; and a second jet plate comprising an array of equally spaced jet nozzles, the second jet plate affixed to said ink ejecting surface and coupled to said second flex circuit.

19. The ink jet cartridge of claim 18, wherein said first jet plate and said second jet plate are manufactured on separate substrates.

20. The ink jet cartridge of claim 19, wherein said separate substrates are separated by a gap devoid of ink ejection nozzles approximately centrally located on said ink ejecting surface.

21. The ink jet cartridge of claim 18, wherein said first side and said second side are on opposing sides of said cartridge.

22. A method of ink jet printing comprising:

mounting a first jet plate comprising an array of equally spaced jet nozzles on an ink jet cartridge;

mounting a second jet plate comprising an array of equally spaced jet nozzles on said ink jet cartridge, wherein said second jet plate is spaced apart from said first jet plate so as to form a gap therebetween devoid of ink ejection nozzles;

compensating for said gap during multipass printing operations with a print mask accounting for the nozzles in the first and second nozzle arrays and the gap.

23. A method of inkjet printing comprising:

depositing ink with a first jet plate mounted on an ink jet cartridge, wherein the first jet plate comprises a first array of equally spaced jet nozzles;

depositing ink with a second jet plate mounted on said ink jet cartridge, wherein the second jet plate comprises a second array of equally spaced jet nozzles on said ink jet cartridge, wherein said second jet plate is spaced apart from said first jet plate so as to form a gap therebetween devoid of ink ejection nozzles;

compensating for said gap during multipass printing operations with a print mask accounting for the nozzles in the first and second nozzle arrays and the gap.

24. The method of ink jet printing of claim 23, wherein the gap is compensated for by one or more jet nozzles of the first or second nozzle array during multi-pass printing operations.

25. The method of ink jet printing of claim 24, wherein the print mask compensates for the gap by having each jet nozzle of a first group of jet nozzles on said first and second jet plates deposit more ink droplets on an associated raster line than the number of ink droplets deposited on another raster line by each jet nozzle of a second group of jet nozzles during multipass printing operations.

26. The method of ink jet printing of claim 25, wherein each nozzle in the first group of jet nozzles deposits about ⅓ of the droplets on a raster line and wherein each nozzle in the second group of jet nozzles deposits about ¼ of the droplets on another raster line during a four pass printing mode.

27. The method of ink jet printing of claim 23, wherein the act of compensating for the gap comprises compensating for a gap configured such that the distance between a first endmost ink jet nozzle on the first jet plate and a second endmost ink jet nozzle on the second jet plate is equal to z times n, wherein z is an integer greater than 1, and wherein n is the interval between adjacent jet nozzles on the first and second jet plates.

28. An inkjet printer system utilizing one or more cartridges, said printer comprising:

a processor which receives print data;

a memory, coupled to the processor, which stores at least one print mask;

a first jet plate comprising equally spaced jet nozzles;

a second jet plate comprising equally spaced jet nozzles, and wherein said first and said second jet plates are physically separated with a small gap therebetween devoid of any jet nozzles; and a means for compensating for said gap with said at least one print mask during multipass printing operations.

* * * * *